United States Patent [19]

Salonica

[11] Patent Number: 4,947,493

[45] Date of Patent: Aug. 14, 1990

[54] PATIENT LIFT DEVICE

[76] Inventor: Frank T. Salonica, 41581 Rte. 39, Wellsville, Ohio 43968

[21] Appl. No.: 826,922

[22] Filed: Feb. 7, 1986

[51] Int. Cl.[5] ..... A47K 11/04

[52] U.S. Cl. ..... 4/476; 4/456; 4/480

[58] Field of Search ..... 4/450, 456, 457, 564–566, 4/254, 476–484, 451, 452, 449; 5/455

[56] References Cited

U.S. PATENT DOCUMENTS

| | | | |
|---|---|---|---|
| 1,295,844 | 3/1919 | Bidwell | 4/456 X |
| 1,981,666 | 11/1934 | Ridley | 4/456 X |
| 2,725,578 | 12/1955 | Keller | 4/565 |
| 3,311,930 | 4/1967 | Bourke | 4/466 |
| 3,605,127 | 9/1971 | Dailey | 4/484 |
| 3,628,197 | 12/1971 | Leventhal | 4/451 |
| 3,728,744 | 4/1973 | Kimbro et al. | 4/456 |
| 4,207,633 | 6/1980 | Smith et al. | 4/456 |
| 4,504,989 | 3/1985 | Maltz | 5/455 |

FOREIGN PATENT DOCUMENTS

| | | | |
|---|---|---|---|
| 2508054 | 2/1976 | Fed. Rep. of Germany | 4/483 |

*Primary Examiner*—Charles E. Phillips

*Attorney, Agent, or Firm*—Harpman & Harpman

[57] ABSTRACT

An apparatus to facilitate the use of bed pans for patients comfined to a bed comprising an inflatable compartment between a base and a removable seat support. The apparatus lifts the patient allowing replacement and retrieval of a bed pan within.

3 Claims, 1 Drawing Sheet

PATIENT LIFT DEVICE

BACKGROUND OF THE INVENTION

1. Technical Field

This device relates to the manipulation of bed-fast patients that require the use of a bed pan by supporting the patient in an elevated manner on the bed.

2. Description of the Prior Art

Prior art devices of this type have relied on a variety of inflatable designs. See for example U.s. Pat. Nos. 3,728,744, 4,207,633 and 4,437,195.

In U.S. Pat. No. 3,728,744, a bed pan apparatus is disclosed which has a generally U-shaped inflatable cushion on a base. The cushion is inflated raising the patient so the pan can be used.

U.S. Pat. No. 4,207,633 shows an inflatable body support that has a seat portion and a back support portion, both of which are made of flexible resilient material.

Finally, U.S. Pat. No. 4,437,195 discloses a self-inflating bed pan that is positioned under a patient and inflated, used, and then removed in an inflated configuration.

SUMMARY OF THE INVENTION

A patient lift device for use with a bed pan configuration that supports the bed fast patient in an elevated manner above the plane of the bed so a pan structure can be used and removed. The device utilizes inflatable compartments between two rigid supports with a removable seat supported by the rigid support in a secure and stable manner during use.

DESCRIPTION OF THE PREFERRED EMBODIMENT

Figure 1:
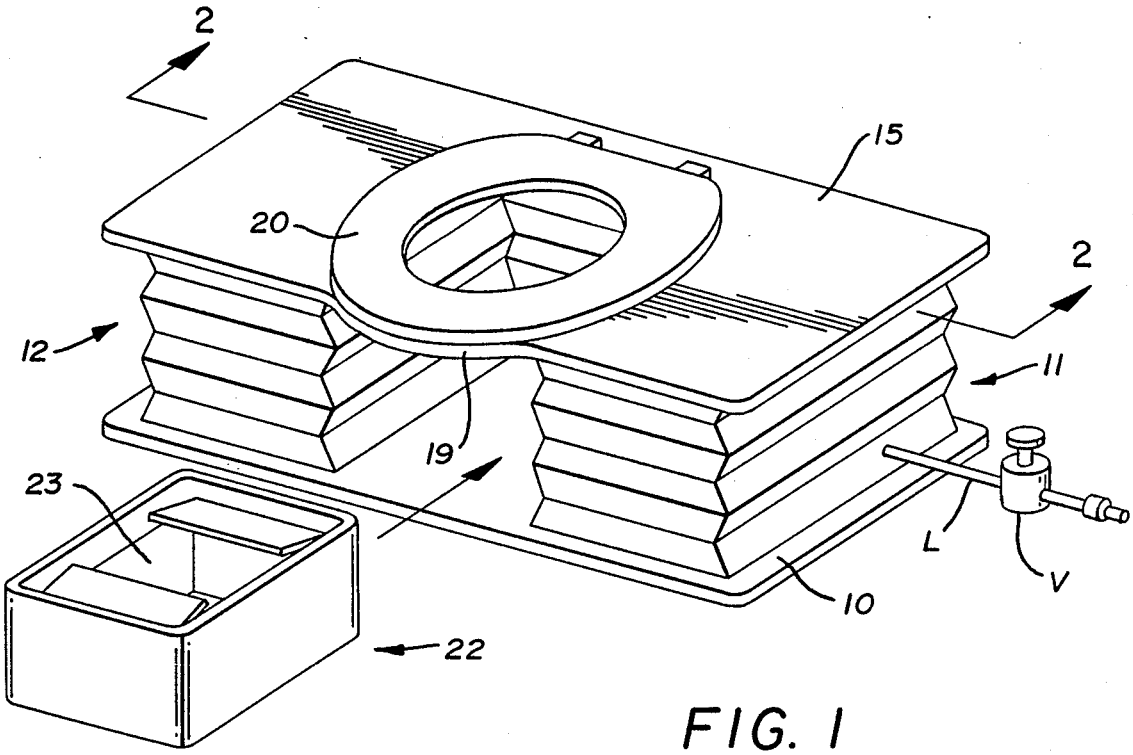
FIG. 1 is a perspective view of the lift device in an inflated configuration.
Figure 2:
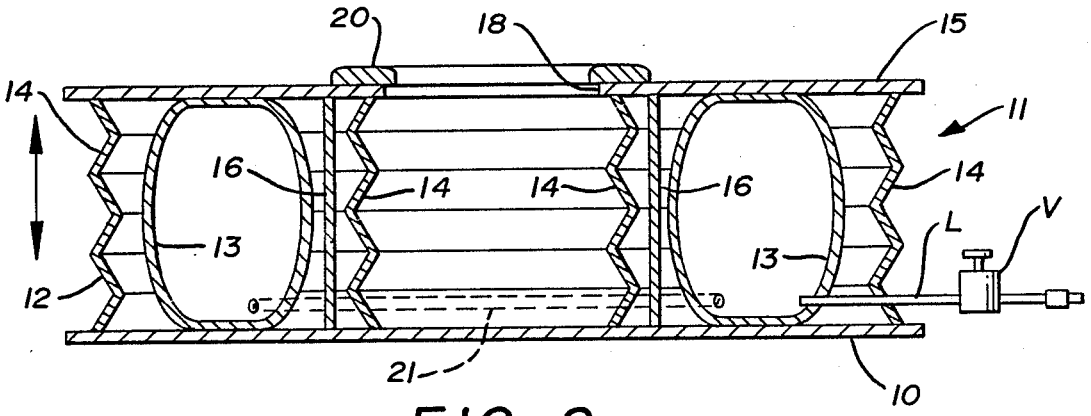
FIG. 2 is a section on line 2—2 of FIG. 1.

Referring to FIGS. 1 and 2 of the drawings, a patient lift device can be seen comprising a rectangular rigid base 10 having a pair of oppositely disposed support enclosures 11 and 12 thereon. Each of the support enclosures 11 and 12 is comprised of an inflatable lift cell 13 of an air impervious material having a cross sectionally ovaloid shape. Each lift cell 13 is enclosed in an accordian bellows multiple sided structure 14 that is secured between the base 10 and a rectangular rigid seat support 15. Flexible partitions 16 are secured between said rigid seat support and the base 10 within each of the support enclosures 11 and 12 and act to limit the total vertical travel therebetween. Each of the lift cells 13 is interconnected to one another by a supply line L having a control valve 17 communicating to a compressed fluid source, (not shown). The seat support 15 has a generally rectangular configuration with an apertured midsection 18 including an offset portion 19 adjacent thereto.

A removable patient seat 20 is temporarily positioned over the aperture as will be well understood by those skilled in the art. The patient seat 20 overlaps the seat support 15 apertured section 18 as best seen in FIG. 2 of the drawings. The lift cells 13 are interconnected by a conduit 21 in communication with each of said cells 13. A waste container 22, as seen in FIG. 1 of the drawings, having a multiple walled enclosure with a disposable insert 23 positioned within said waste container 22 as will be well understood by those skilled in the art.

Figure 3:
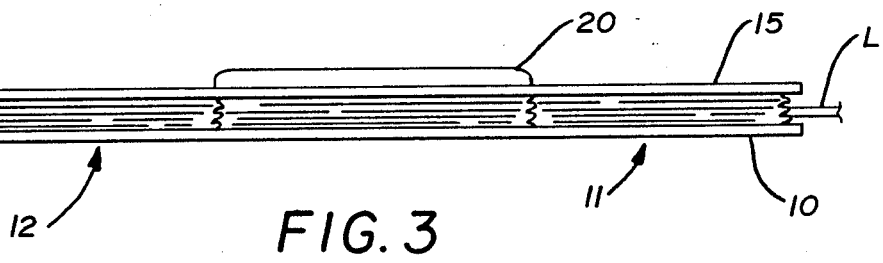
FIG. 3 is a front plan view of the lift device in a collapsed configuration.

In operation, the patient lift device in a collapsed non-inflated form, see FIG. 3 of the drawings, is positioned under the patient (not shown) and inflated by compressed fluid via by the valve V and supply lines L. The lift cells 13 gradually inflate forcing the seat support 15 to raise under the patient lifting same. Once fully inflated as defined by the flexible partition 16, the waste container 22 is positioned on the base 10 between the lift cells 13 directly under the apertured portion 18 of the seat support 15 as hereinbefore described. After use, the reverse procedure is used by removing the waste container 22 and deflating the lift cells 13 and then removing the collapsed patient lift device out from under the patient.

It will thus be seen that a new and useful device for elevating bed fast patients has been illustrated and described and it will be apparent to those skilled in the art that various changes and modifications may be made therein without departing from the spirit of the invention and having thus described my invention, what I claim is:

1. A patient lift seat comprising a rigid base and an apertured rigid seat support in oppositely disposed relation to one another, inflatable support enclosures positioned between said rigid base and rigid seat support, means for inflating said support enclosures and raising said rigid seat support in spaced relation to said rigid base, a flexible partition secured between said rigid base and said rigid seat support within said inflatable support enclosures, a removable seat positioned on said apertured rigid seat support, means for inner-connecting said support enclosure and a waste container removably positioned between said inflatable support enclosures.

2. A patient lift seat of claim 1 wherein each of said inflatable support enclosures comprises an accordian bellows multiple sided structure inner-connected to one another and a inflatable lift cell within said inflatable support enclosure in communication with each other and said means for inflation.

3. The patient lift seat of claim 1 wherein said means for inflating said support enclosures comprises a fluid source under pressure and supply lines and a valve interconnecting the same with said support enclosure.

* * * * *